US005111732A

United States Patent [19]

Marcon et al.

[11] Patent Number: 5,111,732

[45] Date of Patent: May 12, 1992

[54] AUTOMATIC WEAPON WITH SMALL BARREL FOR RAPID FIRING

[75] Inventors: Joël Marcon, St Etienne; Evelyne Montet, Bourges; Didier Gobet, Bourges; Guy Ferrand, Bourges; Patrick Pochard, Bourges; Georges Simon, St Germain Du Puy, all of France

[73] Assignee: Etat Francais, France

[21] Appl. No.: 670,381

[22] Filed: Mar. 14, 1991

Related U.S. Application Data

[63] Continuation of Ser. No. 413,685, Sep. 28, 1989, abandoned.

[30] Foreign Application Priority Data

Sep. 28, 1988 [FR] France ..... 88 12654

[51] Int. Cl.[5] ..... F41A 9/36

[52] U.S. Cl. ..... 89/135; 89/155; 89/33.05; 89/33.25

[58] Field of Search ..... 42/60; 89/33.02, 33.03, 89/33.05, 33.16, 33.25, 126, 135, 155

[56] References Cited

U.S. PATENT DOCUMENTS

| | | | |
|---|---|---|---|
| 1,342,358 | 6/1920 | Storle | 89/155 |
| 2,756,637 | 7/1956 | Maillard | 89/33.02 |
| 2,820,400 | 1/1958 | O'Brien | 89/33.02 |
| 2,849,921 | 9/1958 | Otto | 89/126 |
| 2,993,412 | 7/1961 | Goldsmith | 89/1.7 |
| 3,101,029 | 8/1963 | Johnston et al. | 89/33.02 |
| 3,222,989 | 12/1965 | Kamp | 89/33.25 |
| 3,625,108 | 12/1971 | Smith et al. | 89/1.804 |
| 3,670,863 | 6/1972 | Meier et al. | 89/33.03 |
| 3,688,637 | 9/1972 | Tan | 89/33.03 |
| 3,998,125 | 12/1976 | Hartmann | 89/33.25 |

FOREIGN PATENT DOCUMENTS

| | | | |
|---|---|---|---|
| 867511 | 2/1953 | Fed. Rep. of Germany | 89/155 |
| 1018438 | 1/1953 | France | 89/33.25 |
| 379968 | 7/1964 | Switzerland | 89/33.03 |
| 13504 | of 1892 | United Kingdom | 89/33.25 |
| 2332 | of 1914 | United Kingdom | 89/33.25 |
| 490221 | 8/1938 | United Kingdom | 89/33.25 |

*Primary Examiner*—Stephen C. Bentley
*Attorney, Agent, or Firm*—Parkhurst, Wendel & Rossi

[57] ABSTRACT

A medium caliber automatic firearm with a high firing rate including a star drum which revolves in indexed fashion and which is in line with and driven by a cylinder star wheel, whose rotation is synchronized with that of the star drum, is mounted to the side of and is parallel to the star drum. A stripper is mounted between the star wheel and the star drum in order to separate cartridges from links at a point where the ammunition belt comes out of the star wheel while allowing the links to be evacuated from the firearm. A mechanism is also included which introduces the cartridges into successive chambers of the cylinder, the cartridges being lined up with the chambers by a star drum as the latter rotates.

8 Claims, 12 Drawing Sheets

AUTOMATIC WEAPON WITH SMALL BARREL FOR RAPID FIRING

This is a continuation of application Ser. No. 07/413,685, filed Sep. 28, 1989, now abandoned.

BACKGROUND OF THE INVENTION

This invention relates to medium-caliber automatic firearms with a high rate of firing, particularly but not exclusively intended for equipping aircraft, and featuring a belt-fed cylinder supplied via a star-shaped feed mechanism. Such firearms, which can be single- or dual-barrelled, are gun gas actuated and electrically energized.

Automatic firearms of the type involved must be capable of delivering short bursts with a high rate of firing reached from the very first rounds in order to engage extremely swift targets with a satisfactory hit probability. Very high burst firing rates are achieved using a single multi-barrel gun or several single- or dual-barrel guns installed on a common platform.

Named after their inventor, single multi-barrel guns are typically of the "Gatling" type. They feature n barrels associated with as many bolts housed in a gun rotor.

SUMMARY OF THE INVENTION

This invention applies to and optimizes the multiple gun configuration mentioned above which uses guns that are more compact and lighter, thus easier to install, than the Gatling type guns, while also being safer since a misfired cartridge will remain in the chamber and firing will merely stop. As a counterpart, and considering the current technology which will be summarized hereunder, the rate of firing of the most recent guns of this type remains limited to approximately 1,800 rpm.

The object of the invention is a medium-caliber firearm with a high rate of firing, that is, in excess of 1,800 rpm and possibly up to or even grater than 2,500 rpm, attained from the very start of each burst. Sufficiently compact and light for being easily housed on board an aircraft, this firearm also is to be as safe and reliable as any other firearm of the same type that is currently available.

With this aim in view, the firearm of the type defined in the preamble is typical, as per the invention, in that it includes a star drum subject to indexed motion, which is in line with and rotated by the cylinder. The the star wheel, whose motion is synchronized with that of the star drum, is parallel to and to the side of said star drum. A stripper located between the star wheel and the star drum separates the cartridges from the links where the ammunition belt comes out of said star wheel so that said cartridges are subsequently routed individually to said star drum and that said links are evacuated from the firearm. Provisions are made for ramming the cartridges into the successive chambers of the cylinder after said cartridges are individually lined up with each of said chambers by the star drum as the latter rotates in indexed fashion.

This arrangement allows the rate of firing to be increased regardless of the cartridge length. In conventional firearms, the ammunition belt transmits directly from the star wheel to the cylinder where a pusher expels the cartridges from the links, said star wheel being in line with said cylinder. The ammunition belt thus can be considered as "running through" the firearm, which implies a significant travel of the slide, strong inertia forces and a delay for the cylinder to reach its maximum revolution speed. All these factors result in a relatively low rate of firing. On the contrary, as per the invention, combining the star wheel, the stripper and the star drum allows said pusher to be eliminated and makes the axial travel of the slide, whose primary purpose is to rotate the cylinder and said star drum, independent of the cartridge length. The slide travel therefore can be minimized, and the duration of each firing cycle considerably reduced. For example, considering a conventional 250 mm-long cartridge, the slide travel as per the invention can be on the order of 80 mm only, whereas in conventional firearms travel of the pusher(s) exceeds 300 mm (breech type) or 130 mm (cylinder type).

The stripper is preferably set up so as to expel the cartridges radially rather than axially, thus providing for a shorter overall length of the firearm.

According to a preferable arrangement, the star drum-star wheel coupling can be disconnected so that the cylinder can be emptied by firing the cartridges that load the chambers of said cylinder at the time of disconnection.

The star drum-star wheel coupling preferably includes a gear #1 pinioned on the star drum and meshing with a gear #2 attached to the star wheel at least during normal operation of the firearm. A clutch mechanism then can be installed between gear #2 and the star wheel shaft. This clutch favorably consists of teeth on gear #2 and teeth on a sleeve that rotates with and slides longitudinally on the star wheel shaft. The sleeve translation is controlled so that the star wheel and the star drum can be disconnected by separating said teeth.

According to another favorable arrangement as per the invention, the star drum-star wheel coupling incorporates a damping device preferably consisting of a torsion bar. Since the star wheel shaft is hollow, said torsion bar is favorably located inside said shaft between the latter and gear #2. Finally, a drive mechanism with limited angular travel can be inserted between said hollow shaft and gear #2. This embodiment eliminates excessive stresses on ammunition belt links and consequently reduces firearm jamming hazards.

Finally, the firearm whose cylinder features at least seven chambers also is typical in that the mechanism which successively loads the cartridges into said chambers of said cylinder includes the following:

a fixed helical track which successively acts on the base end of each cartridge in order to combine their indexed rotation on the star drum with an indexed translation inside said star drum so that said cartridges are carried from the position where they are initially introduced in said star drum up to their individual firing position in the cylinder chambers; and a reciprocating slide which is actuated by explosive gases and controls the indexed rotation of the cylinder.

The additional embodiment above allows the rate of firing to be further increased.

BRIEF DESCRIPTION OF THE DRAWINGS

The invention will be discussed in detail hereafter using the appended drawings to support the description.

DETAILED DESCRIPTION OF THE PREFERRED EMBODIMENTS

Figure 2:
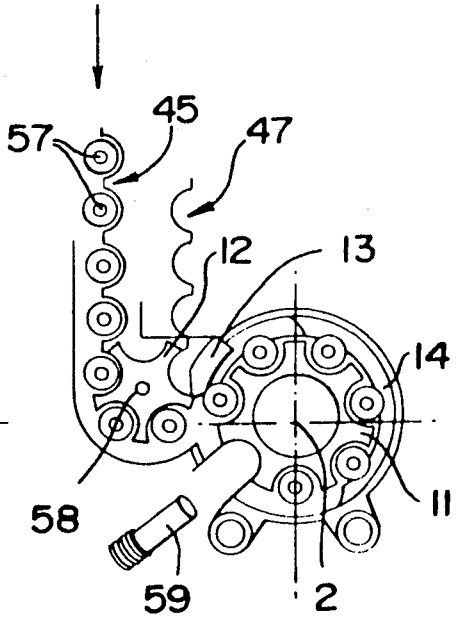
FIGS. 1 and 2 illustrate a single-barrel firearm as per the invention and are respectively a longitudinal section taken on the axis of the single barrel and of the cylinder, and a cross section taken on line II—II shown in FIG. 1.
Figure 1:
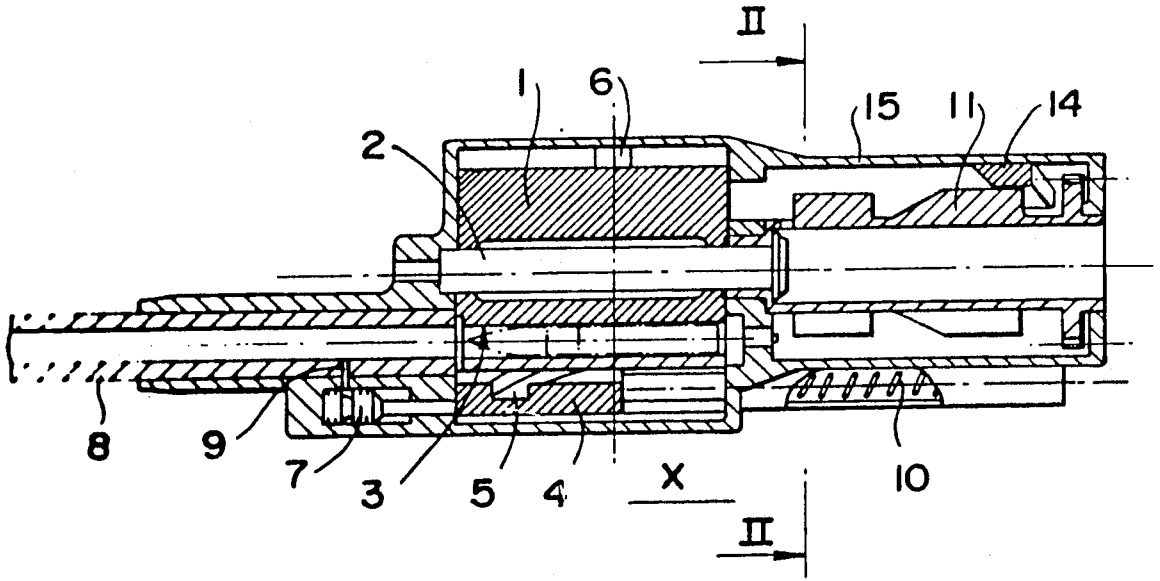

The firearm illustrated in FIGS. 1 and 2 includes:

a cylinder 1 rotating about its axis 2 and housing seven chambers 3 which all are mutually parallel and evenly distributed over a cylindrical spindle having the same axis 2 as cylinder 1;

a slide 4 whose back and forth motion is parallel to axis 2 and which actuates cylinder 1 through a helical groove 5 hollowed out in said slide 4 and in which groove 5 permanently protrude two rollers 6 out of the seven rollers that are evenly distributed over the cylinder 1 circumference, the axis of both rollers 6 being in a same plane perpendicular to axis 2 of cylinder 1;

a piston 7 capable of pushing slide 4 in the direction of arrow X (FIG. 1) under the pressure of the explosion gases collected at each firing cycle from a single barrel 8 through hole 9, the axis of said barrel 8 being parallel to axis 2 of cylinder 1;

recoil springs 10 whose role will be specified later on;

a star drum 11 aft of cylinder 1 and in line with axis 2 of said cylinder 1, said star drum 11 being revolved by said cylinder 1 via claws 42 (FIG. 14) and interacting with a feed star wheel 12 whose shaft 58 is parallel to but offset to the side of said axis 2 of said cylinder 1 so as to convey cartridges 57 to said cylinder 1;

a stripper 13 which extracts from links 47 the cartridges 57 supplied in belts 45;

a helical track 14 which is fixed in relation to the frame 15 of the firearm and whose role will be specified later on.

The helical track 14 winds around star drum 11 over an angle of approximately 195°.

Although it was assumed so far that there were seven chambers 3, seven rollers 6 and seven hollow positions on star drum 11, it should be noted that their number could as well be slightly greater than seven. The lower limit value of seven was selected as a satisfactory tradeoff aimed at reducing the inertia forces affecting the cylinder 1 and star drum 11 assembly when both snap from one stop to the next, while keeping the lateral size of said assembly within reasonable limits.

Figure 4:
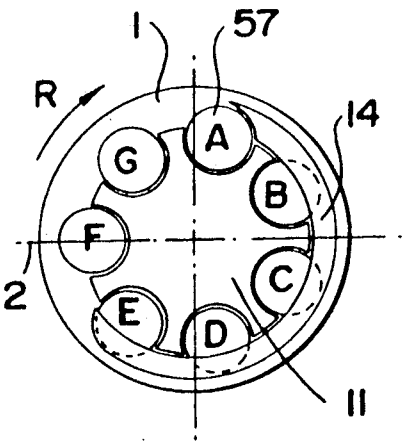
FIGS. 3 and 4 are respectively axial and cross sectional views that sketch the positions of the cylinder, star drum and helical track, FIG. 4 showing an enlarged detail of FIG. 2.
Figure 3:
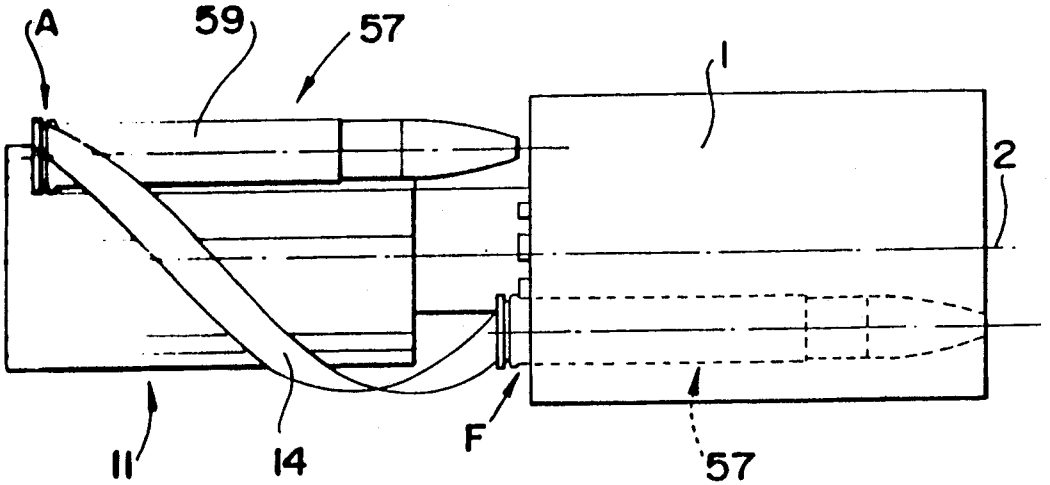
Figure 5:
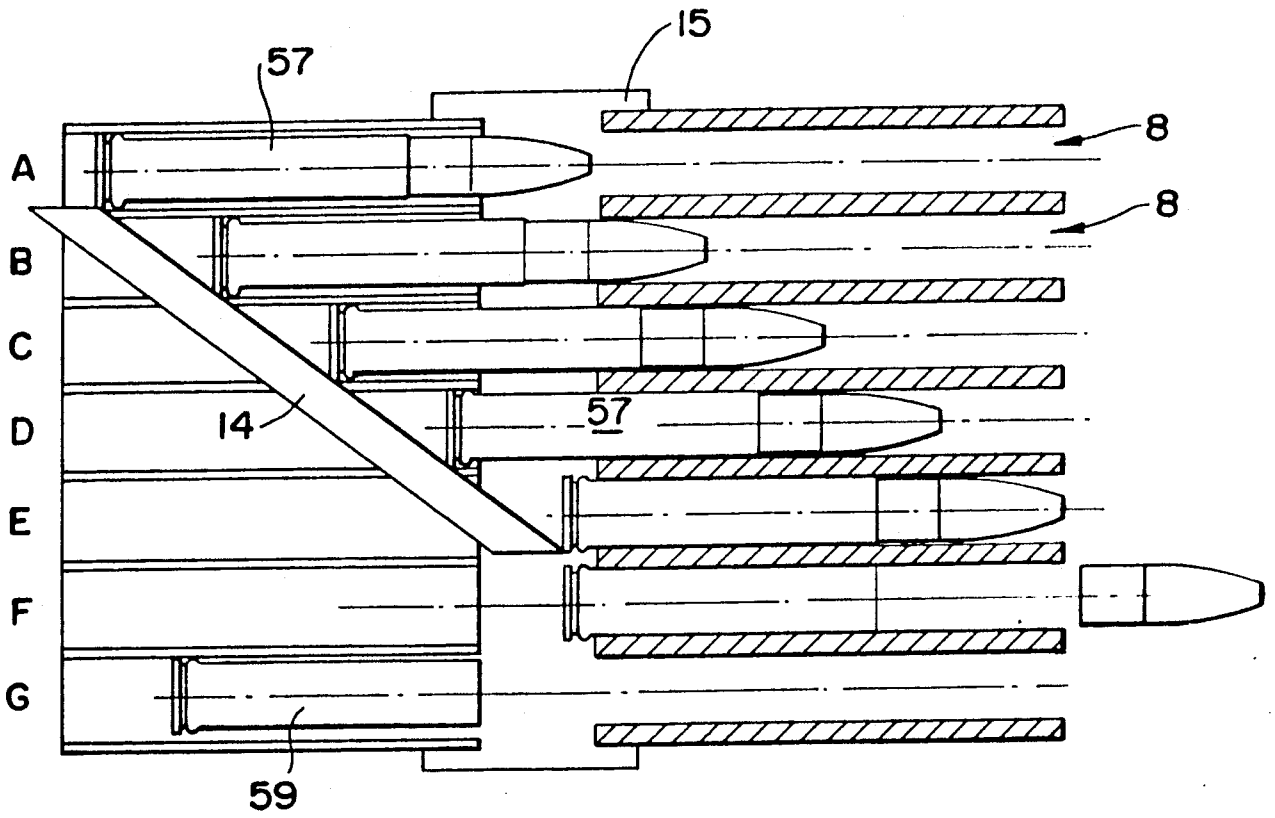
FIG. 5 is a mapping of axial sections showing the successive positions of a cartridge at each interruption of the indexed rotation of the cylinder the star drum.

FIGS. 3 through 5 depict the successive positions of cartridges 57 as they result from the rotation of cylinder 1, in the direction of arrow R, during a firing sequence. Acquisition of a cartridge 57 takes place at station A. The base of case 59 of said cartridge 57 then rests on helical track 14 which progressively introduces (via stations B, C, D and E) said cartridge 57 in the facing chamber 3 of cylinder 1, up to station F where said cartridge 57 is fired, the empty case 59 being ejected from station G.

The firearm operation can be broken down as follows:

When cartridge 57 is fired at station F, part of the explosive gases rush through hole 9 and slam slide 4 which FIG. 1 shows in fore neutral position.

Figure 7:
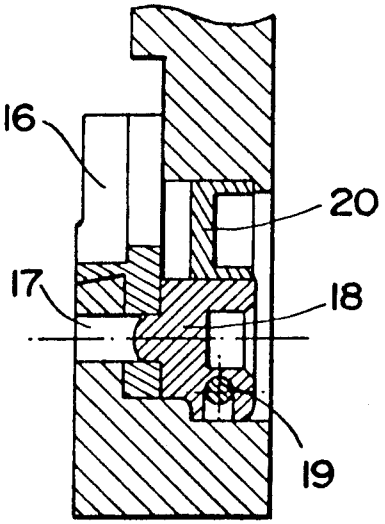
FIGS. 6 through 11 explain the operation of the slide that drives the cylinder, FIG. 7 being a fragmentary section taken on line VII—VII in FIG. 6 and FIG. 10 being a section taken on line X—X in FIG. 9.
Figure 6:
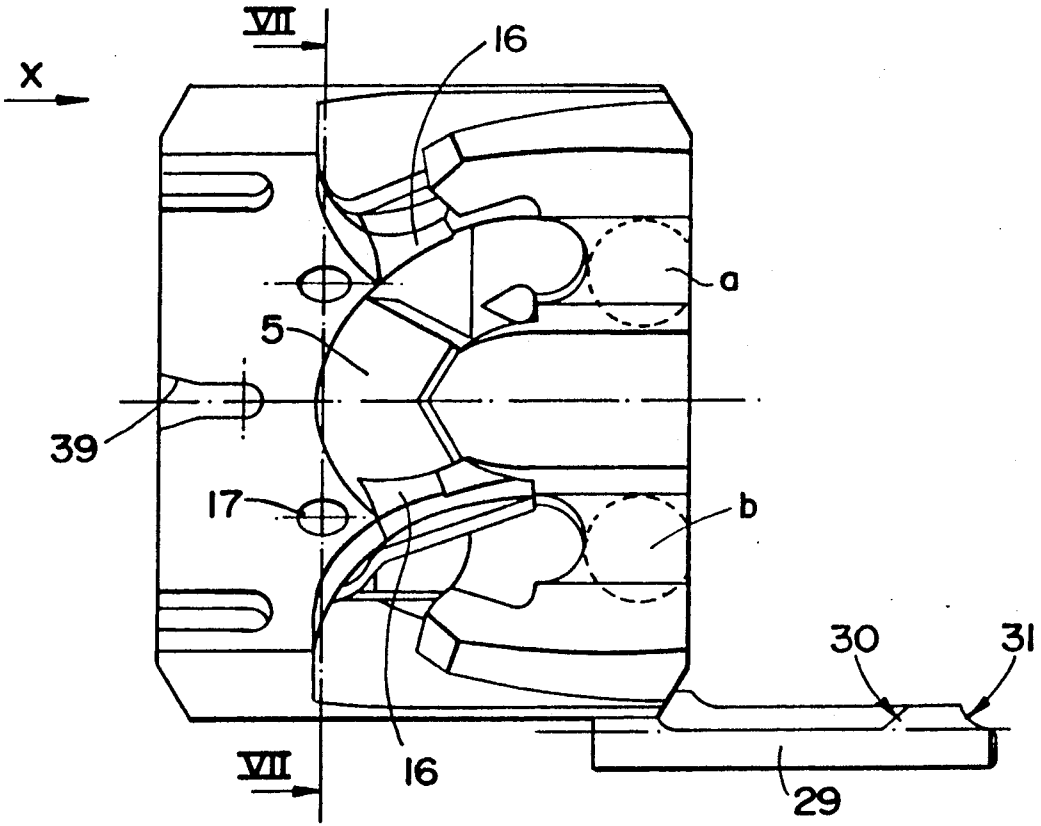

During slide 4 travel, the two rollers 6 engaged in groove 5 make cylinder 1 rotate. Said groove 5 incorporates two switching devices 16 (FIGS. 6 and 7) pivoting about pins 17 and determining the path of said rollers 6 according to the forward or rearward motion of said slide 4. It should be noted that the simultaneous use of two rollers 6 for generating the rotation of cylinder 1 is only dictated by reliability considerations concerning the mechanical strength of the axle of said rollers 6, since the firearm can operate satisfactorily with only one roller engaged.

Figure 9:
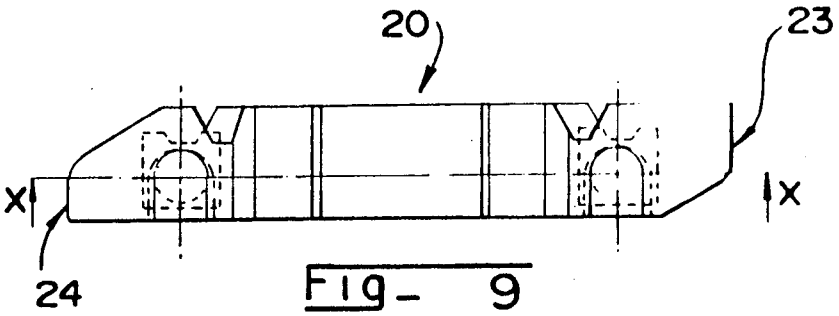
Figure 8:
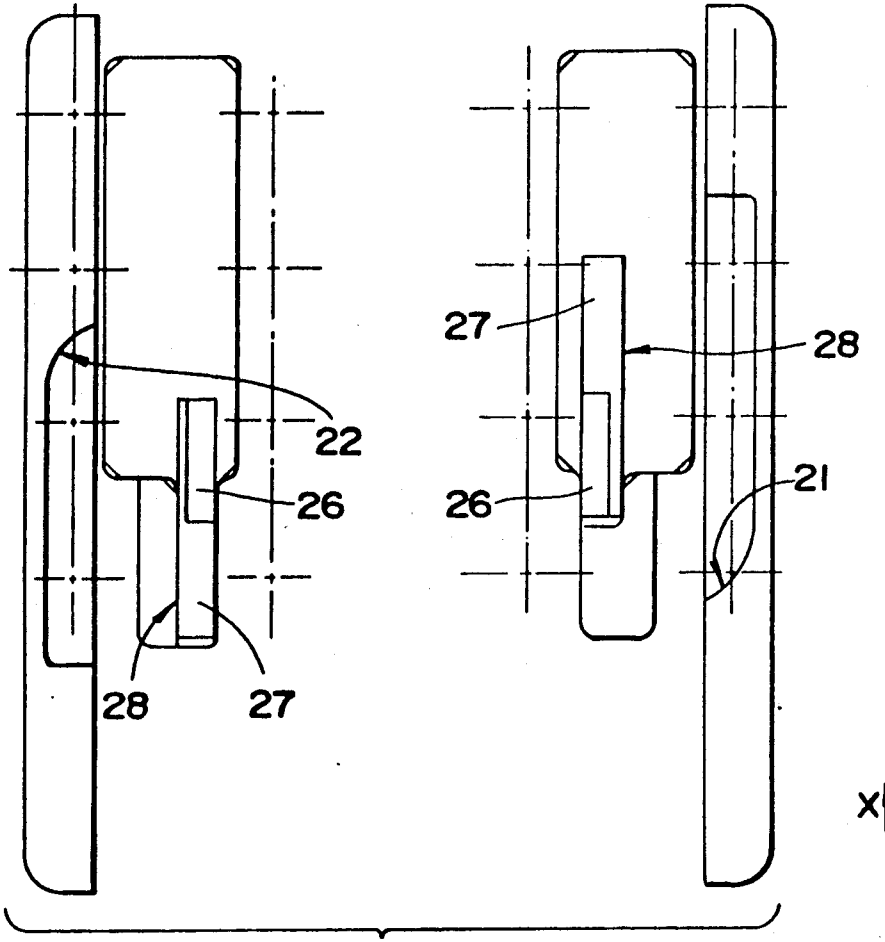

The switching devices 16 are attached to pinions 18 (FIG. 7) secured by pins 19 and meshing with a rack 20. Said rack 20 is driven by and travels back and forth with respect to slide 4 perpendicularly to the firearm axis. The direction and amplitude of rack 20 motion are determined by guide rails 21 and 22 which are parallel to the firearm axis and are fixed on frame 15; the ends 23 and 24 of rack 20 (FIGS. 8 and 9) come to rest alternately on said guide rails 21 and 22.

Figure 10:
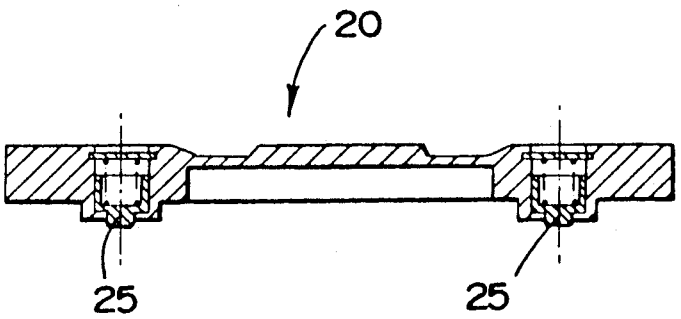
Figure 11:
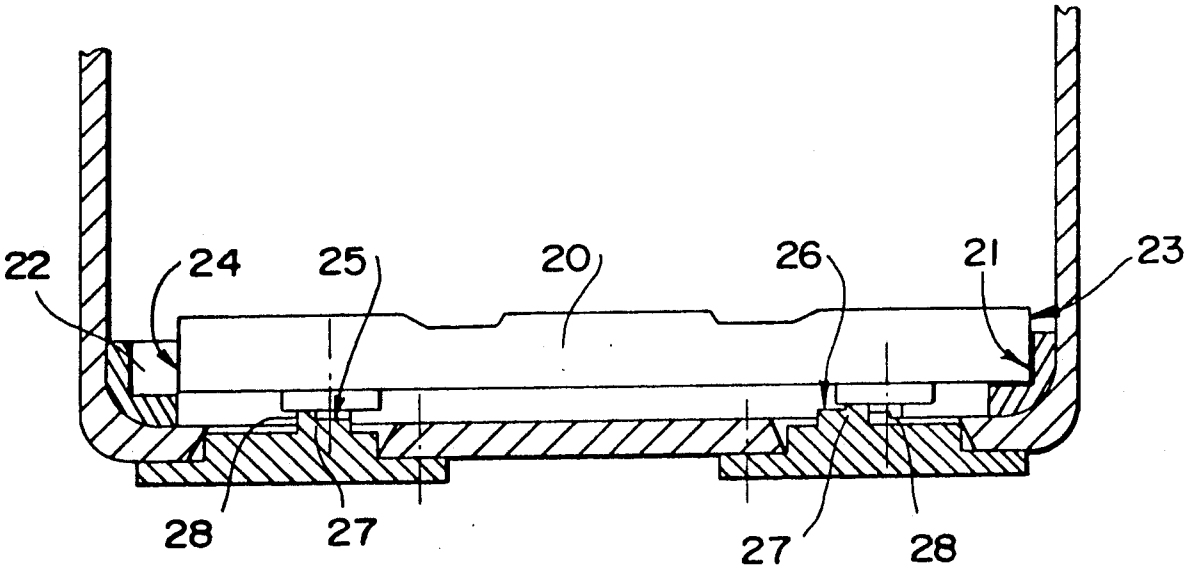

In order to maintain the switching devices 16 in a fixed and determined position during the motions of slide 4, rack 20 is locked on either one of guide rails 21 and 22 by protruding slugs 25 (FIGS. 10 and 11) which retract when pushed in by shoulders 26 cut in studs 27 that are secured on frame 15 and whose side faces act as stops combined with slugs 25 so as to intermittently freeze the translation of rack 20.

When a cartridge 57 is fired, slide 4 is slammed by piston 7 in the direction X (FIGS. 1 and 6) and drags rollers 6 whose interaction with groove 5 and switching devices 16 up to the aft neutral position of said slide 4 causes cylinder 1 to move one-fourteenth of a revolution. Owing to the kinetic energy built up in cylinder 1 and to the action of the recoil springs 10, slide 4 is propelled forward. During this forward travel, rack 20 moves sideways and makes the switching devices 16 pivot. In a single to and fro cycle, the active roller 6 travels from position a to position b (FIG. 6) and cylinder 1 moves one-seventh of a revolution, which brings a new cartridge 57 to firing station F and empty case 59 to ejection station G. If firing stops at this instant, the recoil springs 10 maintain slide 4 in the fore neutral position and the firearm is ready to resume firing.

Figure 12:
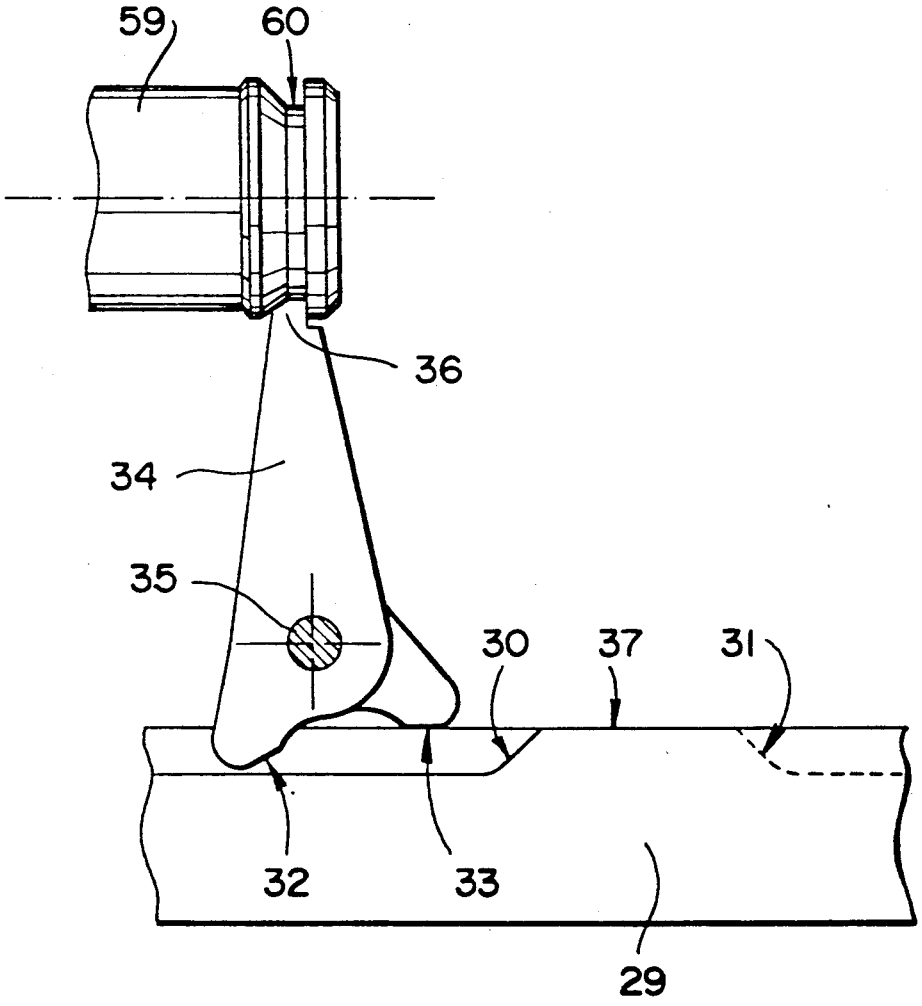
FIGS. 12 and 13 illustrate the ejection mechanism for empty cases, FIG. 12 being an enlarged view of a detail in FIG. 13.
Figure 13:
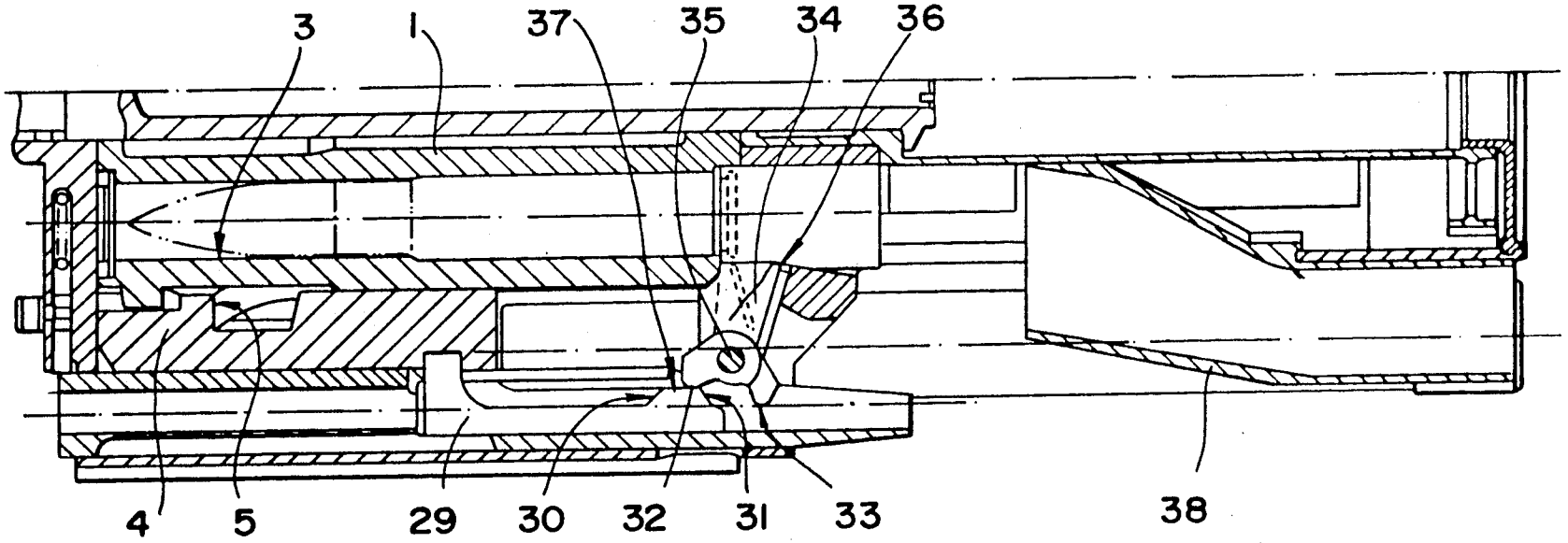

When travelling back and forth, slide 4 drives a saddle 29 (FIGS. 12 and 13) that carries two tracks 30 and 31 which alternately press on the two legs 32 and 33 of an ejector 34 that pivots about an axle 35 secured on the firearm frame 15, so that the tip 36 of said ejector 34 can engage the groove 60 cut in the base end of case 59 (FIG. 12). During the firing sequence and when slide 4 initiates its rearward travel, track 31 starts pressing on leg 33 of ejector 34 and makes said ejector pivot so that tip 36 is brought in the plane of groove 60 in the base end of case 59. Ejector 34 is maintained in same position by leg 33 which rests on face 37 of saddle 29 until cylinder 1 rotates and brings the empty case 59 against tip 36, at which time track 30 of said saddle 29 hits leg 32 of said ejector 34 following the motion of slide 4 toward the fore neutral position. The empty case 59 then is ejected in a chute 38 and ejector 34 resumes its initial position (FIG. 13).

When slide 4 is in the fore neutral position, cylinder 1 is prevented from rotating by mortises 39 which catch tenons 40 (FIG. 14) so that chambers 3 are correctly positioned opposite the electric primer 41 whose design is well known in the art.

Figure 14:
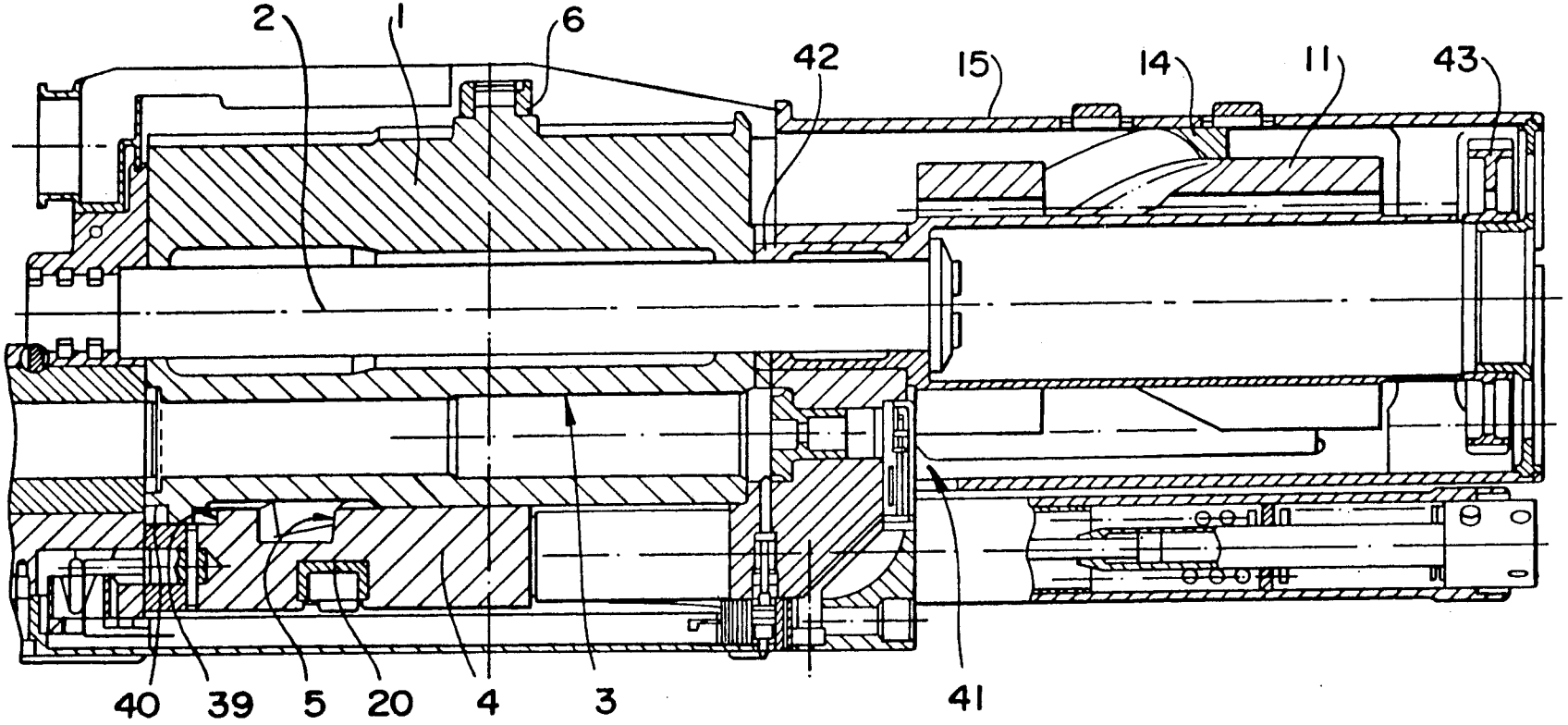
FIGS. 14 and 15 illustrate the firearm feed system and are respectively an axial section with phantom parts and a cross section at a larger scale.

When rotating, cylinder 1 makes star drum 11 revolve by means of coupling claws 42 (FIG. 14). Said star drum 11 has seven branches which are the walls of an equivalent number of receptacles facing the seven chambers 3 of cylinder 1, and also has on its aft side a pinion 43 which meshes with a pinion 44 (FIG. 16) coupled with star wheel 12 by means of a device that will be detailed later on using FIGS. 16 through 19.

Figure 15:
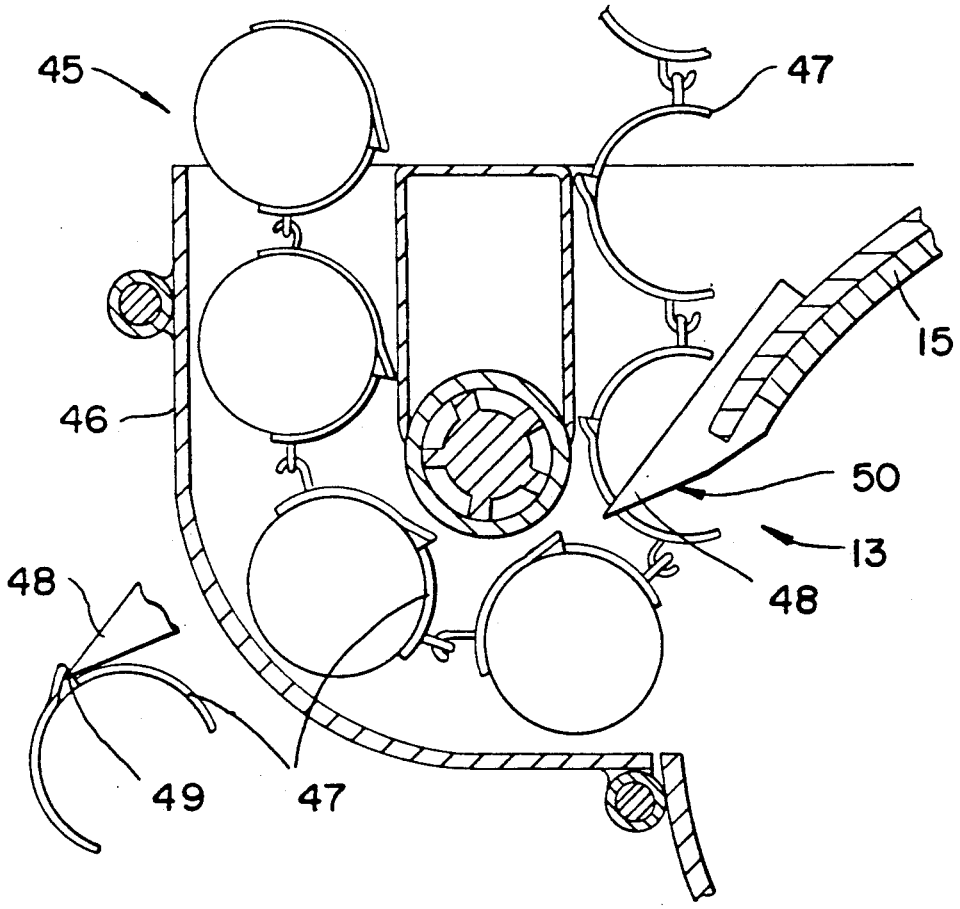

The cartridges, in the form of an ammunition belt (FIG. 15) whose links 47 are pulled by star wheel 12, come opposite the stripper 13 which is secured on frame 15. Said stripper 13 is a fork with two parallel prongs 48 which are forced under the lids 49 in links 47 and thus expel cartridges 57 radially instead of axially as is usually done in most medium-caliber firearms available today. After being freed from its link 47, the cartridge is guided by a bearing surface 50 which pushes said cartridge into the facing receptacle in star drum 11.

The base of the cartridge case then rests axially against helical track 14 whose action combined with the rotation of cylinder 1 progressively pushes said cartridge home in its chamber 3 in a sequence that begins at station A and ends at station E of said cylinder 1 (FIGS. 4 and 5).

Separated from its cartridge 57, empty link 47 then is evacuated and consequently never penetrates inside the firearm. This arrangement eliminates the jamming hazard which prevails when the ammunition belt runs through the firearm since empty links often break loose and jam the feed mechanism or even cause such heavy damage that said firearm is no longer serviceable.

Figures 16, 17, 18, 19:
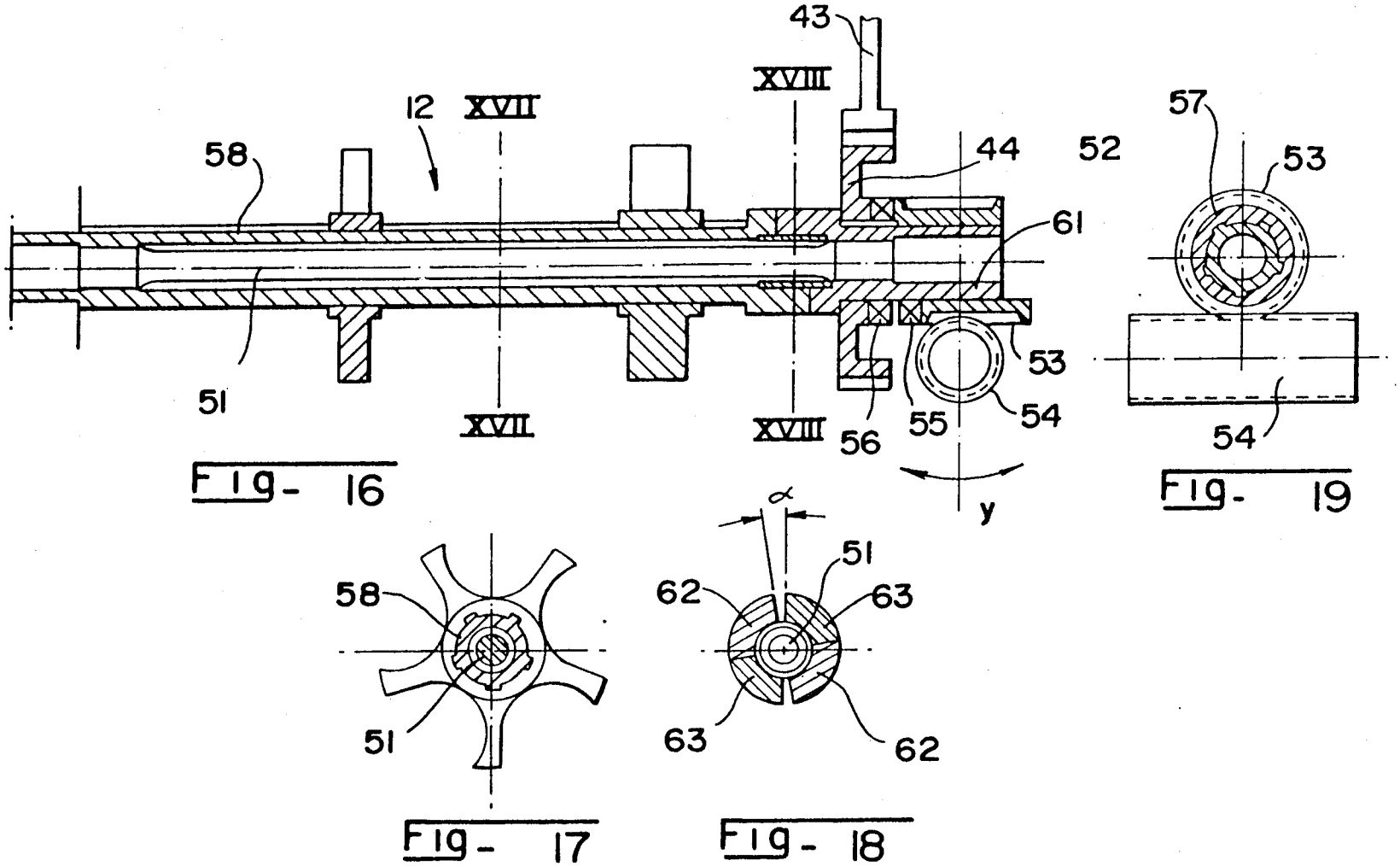
FIGS. 16 through 19 illustrate the actuating mechanism of the ammunition feed system and are respectively an axial section and cross sections taken on lines XVII—XVII, XVIII—XVIII and XIX.XIX in FIG. 16.

High rates of firing generate sharp pulls that stress the ammunition belt by jerks. Links 47 therefore are likely to be bent out of shape, which makes the belt lengthen and may cause feed problems. This is why star wheel 12 is fitted with a damping device which smoothens out the tensile forces and makes belt lengthening negligible. Said damping device (FIGS. 16 through 19) mainly consists of a torsion bar 51 located between the shaft 58 of star wheel 12 and the pinion 44 that drives said star wheel. As shown in FIGS. 16 and 17, said shaft 58 is hollow and said torsion bar 51 is mounted inside said shaft 58.

Star wheel 12 can be easily disengaged at any time, should the firearm be unloaded, for example. This is achieved through a claw coupling that consists of a sliding sleeve 52 whose external face supports a cylindrical rack 53 meshing with a pinion 54 which can be partially rotated on either side (as illustrated by double-end arrow in FIG. 16) by a lever that is not shown. On the side facing pinion 44, said sleeve 52 has teeth 55 that can mesh with teeth 56 of said pinion 44 (as illustrated in the upper part of FIG. 16) and that can be disengaged when pinion 54 rotates (as illustrated in the bottom part of FIG. 16).

For torsion bar 51 to play its damper role, a limited relative angular travel (FIG. 18) is made possible between hollow shaft 58 of star wheel 12, on which is fixed one end of torsion bar 51, and pinion 44, in the hub 61 of which is fixed the other end of said torsion bar 51 (FIG. 16). Hollow shaft 58 and hub 61 have claws 62 and 63, respectively (FIG. 18), which mutually mesh through the limited angular travel mentioned above.

In order to prevent the damages incurred by a cartridge 57 being introduced into an already loaded chamber 3, the firearm incorporates an electrical safety device which is not illustrated herein. This device can be:

either a mechanical contact pressed by the base end of a case as long as said case is not ejected, or a proximity sensor detecting the presence of a case.

In both cases, the contact/sensor delivers an electrical signal that is interpreted by the electronic logic circuits of the firearm which may decide to stop firing, if required. No mechanical shock occurs during the process and, consequently, there is no risk of damage to the firearm.

In order to cope with a possible misfiring, the firearm incorporates a multiple-action rearming device that is known to the art and can be of pyrotechnic type.

Although all of the above relates to a single-barrel 8 firearm, a dual-barrel variant can be envisaged along the same principle of operation. Such a configuration could be beneficial if the firearm were to be used on board a vehicle with a large ammunition storage capacity, in which case barrel wear and heating would be lessened.

Figure 20:
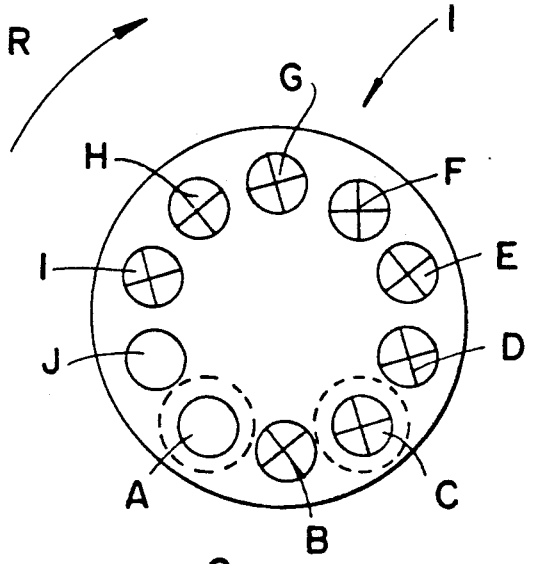
FIGS. 20 through 22 are sketched views illustrating the operation of a dual-barrel firearm devised as a variant of the mode depicted in FIGS. 1 through 19.
Figure 21:
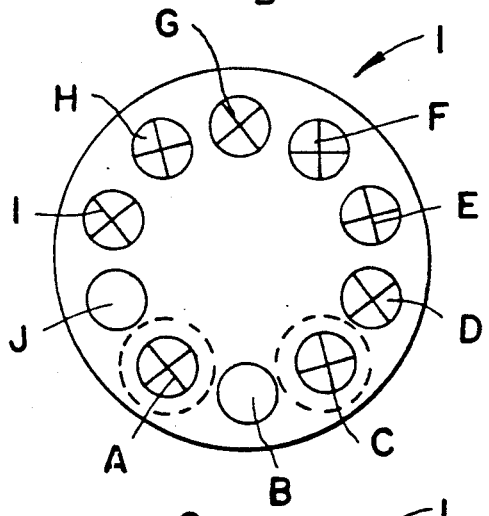
Figure 22:
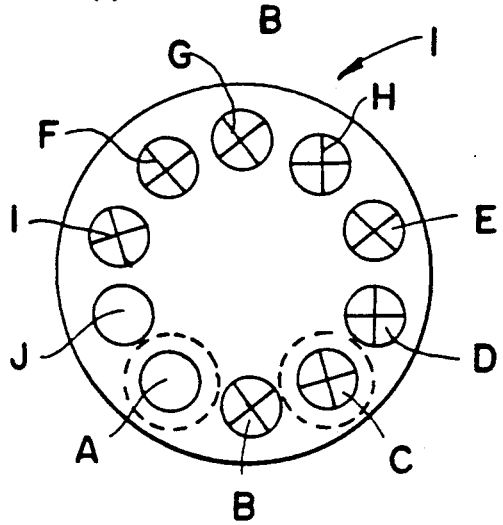

Using a single feed system and a single ejector together with two firing systems, and on condition that the explosive gases collection be adapted, a dual-barrel firearm could fire through each barrel alternately. For example, in a ten-chamber cylinder revolving in direction R and illustrated in FIGS. 20 through 22, stations A and C correspond to barrel #1 and barrel #2 respectively, station J is where the empty case is ejected and station I is where cartridge introduction begins; stations marked with a cross are those housing a cartridge not yet fired. The first firing cycle is initiated by firing the cartridge at station C (FIG. 20), which makes cylinder 1 rotate by one-tenth of a revolution. FIG. 21 illustrates the configuration reached upon completion of the first firing cycle. The second firing cycle is initiated by firing the cartridge at station A, which makes cylinder 1 rotate by an additional one-tenth of a revolution. FIG. 22 illustrates the configuration reached upon completion of the second firing cycle, said configuration being identical with the initial one. The third firing cycle then is initiated by firing the cartridge at station C.

The above demonstrates that a dual-barrel firearm operates by firing through each barrel alternately. It only requires an adaptation of the firing system which also must feature an adequate safety device so as to prevent both barrels from firing simultaneously, in which case the firearm operation would stop and mechanical parts would likely break down due to the additional stresses generated by said simultaneous firing.

On the other hand, and considering the greater inertia of the cylinder, the design rate of firing can be reduced.

As compared with medium-caliber firearms known today, the firearm as per the invention is particularly performing and attractive owing to the numerous innovative features and characteristics that it embodies:

lateral cartridge-link separation combined with the helical feed track 14, which allows the rate of firing to be increased regardless of cartridge length, as explained earlier in the firearm description.

maximum rate of firing available instantaneously, which means that the single-barrel firearm can fire 21 rounds within a 0.5 s burst, superior reliability through redundancy (two active rollers, fully positive extractor control, auxiliary rearming system in case of misfiring etc.) and through feed system design, ergonomics (left-hand or right-hand side ammunition feed, star wheel disengagement capability) combined with compactness and light weight (approximately 110 kg), which all make the firearm particularly suitable for use on board an aircraft, overall design resulting, as per the invention, in a firearm that is simply and easy to operate.

We claim:

1. A medium caliber automatic firearm, comprising:

a rotatable cylinder comprising a plurality of radially spaced cartridge chambers, each cartridge chamber being successively aligned with at least one barrel operating on explosive gases generated from firing cartridges;

a feeding device comprising in combination (1) a star drum axially aligned with and driven in indexed rotation by said rotatable cylinder, (2) a star wheel mounted to the side of and axially parallel to said star drum, (3) by a coupling device provided between said star drum and said atar wheel to rotate said star wheel synchronously with said star drum, (4) means disconnecting said coupling device to empty said cylinder, said star wheel contacting links of an ammunition belt partially wound around said star wheel to drive said belt relative to the rotation of said star drum and to supply ammunition cartridges to said star drum, and (5) a stationary stripper mechanism interposed between said star drum and said star wheel to separate radially ammunition cartridges from the links of the ammunition belt and to convey individually the cartridges to said star drum while allowing the links to be evacuated from the firearm;

means for introducing the conveyed cartridges into successive chambers of the rotatable cylinder, the cartridges being aligned with said chambers as said star drum rotates; and electrical means for detonating said cartridges.

2. The firearm of claim 1, further comprising slide means arranged adjacent to and in contact with said cylinder and piston means operating under pressure of said explosive gases, said slide means and said piston means acting in concert to rotate said cylinder.

3. The firearm of claim 2, wherein said slide means comprise a slide member having a helical groove formed therein, and said cylinder includes at least one roller which rides in said helical groove.

4. The automatic firearm of claim 1, wherein said coupling device further comprises a first pinion fixed on said star drum and meshing with a second pinion driven by said star wheel at least during normal operation of the firearm.

5. The firearm of claim 4, further comprising a claw coupling installed between said second pinion and a shaft of said star wheel.

6. The firearm of claim 5, wherein said claw coupling consists of teeth on said second pinion that mesh with teeth on a sleeve rotating with said shaft of said star wheel and sliding longitudinally along said shaft under the control of a mechanism which disengages said star wheel from the shaft of said star wheel by separating said teeth.

7. The firearm of claim 1, wherein said coupling device further comprises a damping device.

8. The firearm of claim 1, wherein said stripper comprises a fork-shaped structure having two parallel prongs which are forced under lids provided in the links of said ammunition belt to radially separate said cartridges from said ammunition belt.

* * * * *